US007096092B1

(12) United States Patent
Ramakrishnan et al.

(10) Patent No.: US 7,096,092 B1
(45) Date of Patent: Aug. 22, 2006

(54) METHODS AND APPARATUS FOR REMOTE REAL TIME OIL FIELD MANAGEMENT

(75) Inventors: Terizhandur S. Ramakrishnan, Bethel, CT (US); Raj Kumar Michael Thambynayagam, Ridgefield, CT (US); Peter Gerhard Tilke, Ridgefield, CT (US); Bhavani Raghuraman, Wilton, CT (US)

(73) Assignee: Schlumberger Technology Corporation, Ridgefield, CT (US)

( * ) Notice: Subject to any disclaimer, the term of this patent is extended or adjusted under 35 U.S.C. 154(b) by 812 days.

(21) Appl. No.: 09/705,674

(22) Filed: Nov. 3, 2000

(51) Int. Cl.
*G05D 7/00* (2006.01)
*G06F 19/00* (2006.01)

(52) U.S. Cl. ..... 700/281; 702/13; 340/853.1

(58) Field of Classification Search ..... 700/281, 700/282, 9; 702/6–13; 340/853.1, 853.3; 166/267, 66, 53, 66.1, 250.01; 705/412, 705/1; 709/217
See application file for complete search history.

(56) References Cited

U.S. PATENT DOCUMENTS

| | | | | |
|---|---|---|---|---|
| 5,467,823 | A | 11/1995 | Babour et al. | 166/250.01 |
| 5,983,164 | A * | 11/1999 | Ocondi | 702/12 |
| 6,456,902 | B1 * | 9/2002 | Streetman | 700/282 |
| 6,498,988 | B1 * | 12/2002 | Robert et al. | 702/6 |
| 6,510,350 | B1 * | 1/2003 | Steen et al. | 700/9 |
| 6,519,568 | B1 * | 2/2003 | Harvey et al. | 705/1 |
| 6,658,460 | B1 * | 12/2003 | Streetman et al. | 709/217 |
| 6,677,861 | B1 * | 1/2004 | Henry et al. | 340/855.3 |
| 6,873,267 | B1 * | 3/2005 | Tubel et al. | 340/853.3 |
| 2002/0035551 | A1 * | 3/2002 | Sherwin et al. | 705/412 |

FOREIGN PATENT DOCUMENTS

WO WO 91/01481 * 2/1991

OTHER PUBLICATIONS

Press, W. H. et al. *Numerical Recipes in Fortran. Hemisphere Publishing, Cambridge University Press, Cambridge* (1992), pp. 557-565, 584-599, and 644-648.
Putnam, Frederick A. *Internet-Based Data Acquisition and Control. Sensors 16* (11):60-63, 1999.
Ramakrishnan, T. S. et al. *Testing Injection Wells with Rate and Pressure Data. SPE Formation Evaluation* (Sep. 1994) pp. 228-236.

* cited by examiner

*Primary Examiner*—Leo Picard
*Assistant Examiner*—Steven R. Garland
(74) *Attorney, Agent, or Firm*—David P. Gordon; Jody Lynn DeStefanis; William L. Wang

(57) ABSTRACT

A method of managing oil fields include installing oil field sensors, coupling them to a local CPU having memory, programming the CPU for data collection and data analysis, and coupling local oil field CPUs to a web server. Human experts are granted access to oil field data in real time via the Internet. The local CPUs provide different levels of data to the web server. The web server provides the option to view raw data, partially analyzed data, or fully analyzed data. The local CPUs are programmed with parameters for analyzing the data and automatically determining the presence of anomalies. Upon detecting the occurrence of an anomaly, the local CPUs are programmed to notify one or more human experts by email, pager, telephone, etc. If no human expert responds to the notification within a programmed period of time, the local CPU automatically takes a programmed corrective action.

31 Claims, 11 Drawing Sheets

METHODS AND APPARATUS FOR REMOTE REAL TIME OIL FIELD MANAGEMENT

BACKGROUND OF THE INVENTION

1. Field of the Invention

The invention relates to methods and apparatus for oil field management. More particularly, the invention relates to methods and apparatus for remotely monitoring oil field reservoir data in real time.

2. State of the Art

During the production of fluids such as hydrocarbons and/or gas from an underground reservoir, it is important to determine the development and behavior of the reservoir to allow production to be controlled and optimized and also to foresee changes which will affect the reservoir in order to take appropriate corrective measures.

Methods and devices for determining the behavior of underground reservoirs, for example by measuring the pressure of fluids, are well known in the prior art. It is known to locate a pressure gauge at the bottom of a production well and connect it to the surface by a cable or other communication means. It is also known to generate a pressure pulse in one well and measure the change in pressure in a nearby well. With these methods, it is necessary to carry out extensive model fitting and complex calculations to determine the behavior and properties of the reservoir.

U.S. Pat. No. 5,467,823 discloses methods and apparatus for long term monitoring of reservoirs. The methods include lowering a sensor into a well to a depth level corresponding to the reservoir, fixedly positioning the sensor while isolating the section of the well where the sensor is located from the rest of the well, and providing fluid communication between the sensor and the reservoir. The apparatus include at least one sensor responsive to a property (e.g. pressure) of fluids and means for perforating a cement layer to provide a channel for fluid communication between the sensor and the reservoir. The methods and apparatus provide a long term installation for monitoring an underground fluid reservoir traversed by at least one well.

All of the known methods and apparatus for monitoring reservoirs require that the data be analyzed by human experts in order to interpret it. This analysis typically occurs on site, requiring human experts to travel from one site to another in order to interpret oil field data. It would clearly be advantageous to allow human experts to access this data remotely, thereby saving otherwise wasted travel time.

Communication systems are known in the art whereby oil field data is transmitted to a central location for analysis. For example, the WELLWATCHER™ system from Schlumberger continuously transmits (via satellite) subsurface sensor data to a centrally located analysis and data repository center. Although the WELLWATCHER™ system provides many advantages, there remain several disadvantages of oil field data analysis which are not addressed by the WELLWATCHER™ system. One apparent disadvantage is that the "central location" may not be conveniently located for all of the human experts involved with a particular oil field. Another, less apparent, disadvantage is that there is too much raw data.

One of the disadvantages of oil field data analysis that has gone largely unaddressed in the art is that most of the analyzed data provides no important information, yet requires as much effort to interpret as the data which provides important information. This is to say that, more often than not, the analyzed data indicates that the oil field is producing at an efficient rate and there have been no changes in the reservoir requiring corrective action. As a result, human experts analyzing oil field data spend most of their time analyzing data that provide no new information about the reservoir.

SUMMARY OF THE INVENTION

It is therefore an object of the invention to provide methods and apparatus for remote real time oil field management.

It is also an object of the invention to provide methods and apparatus for remote real time oil field management whereby oil field data can be accessed by human experts from virtually anywhere in the world.

It is another object of the invention to provide methods and apparatus for remote real time oil field management whereby oil field data need not be constantly analyzed in order to detect an anomaly.

It is still another object of the invention to provide methods and apparatus for remote real time oil field management whereby human experts only need to analyze oil field data in the event of an anomaly.

In accord with these objects which will be discussed in detail below, the methods of the present invention include installing oil field sensors in a conventional manner, coupling the sensors to a local CPU having memory, programming the CPU for data collection and data analysis, providing a central web server coupled to the Internet, and coupling local oil field CPUs to the web server. According to one aspect of the invention, human experts are permitted to access oil field data in real time via the Internet by connecting to the web server and requesting data for a particular oil field. According to another aspect of the invention, the local CPUs provide different levels of data to the web server. The web server provides the option to view raw data, partially analyzed data, or fully analyzed data. According to another aspect of the invention, the local CPUs are programmed with parameters for analyzing the data and automatically determining the presence of anomalies. Upon detecting the occurrence of an anomaly, the local CPUs are programmed to notify one or more human experts by email, pager, telephone, etc. If no human expert responds to the notification within a programmed period of time, the local CPU automatically takes a programmed corrective action.

Preferred aspects of the invention include: storing data differently according to the age of the data, e.g. finely sampled data is stored for recently acquired data and older data is more sparsely sampled. According to a presently preferred embodiment, data is automatically analyzed using one or more algorithms including "bound check", "trend check", "function check", "correlation check", and "covariance check". An exemplary "correlation check" is provided which utilizes signal processing methods without utilizing an underlying model of the reservoir.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 1:
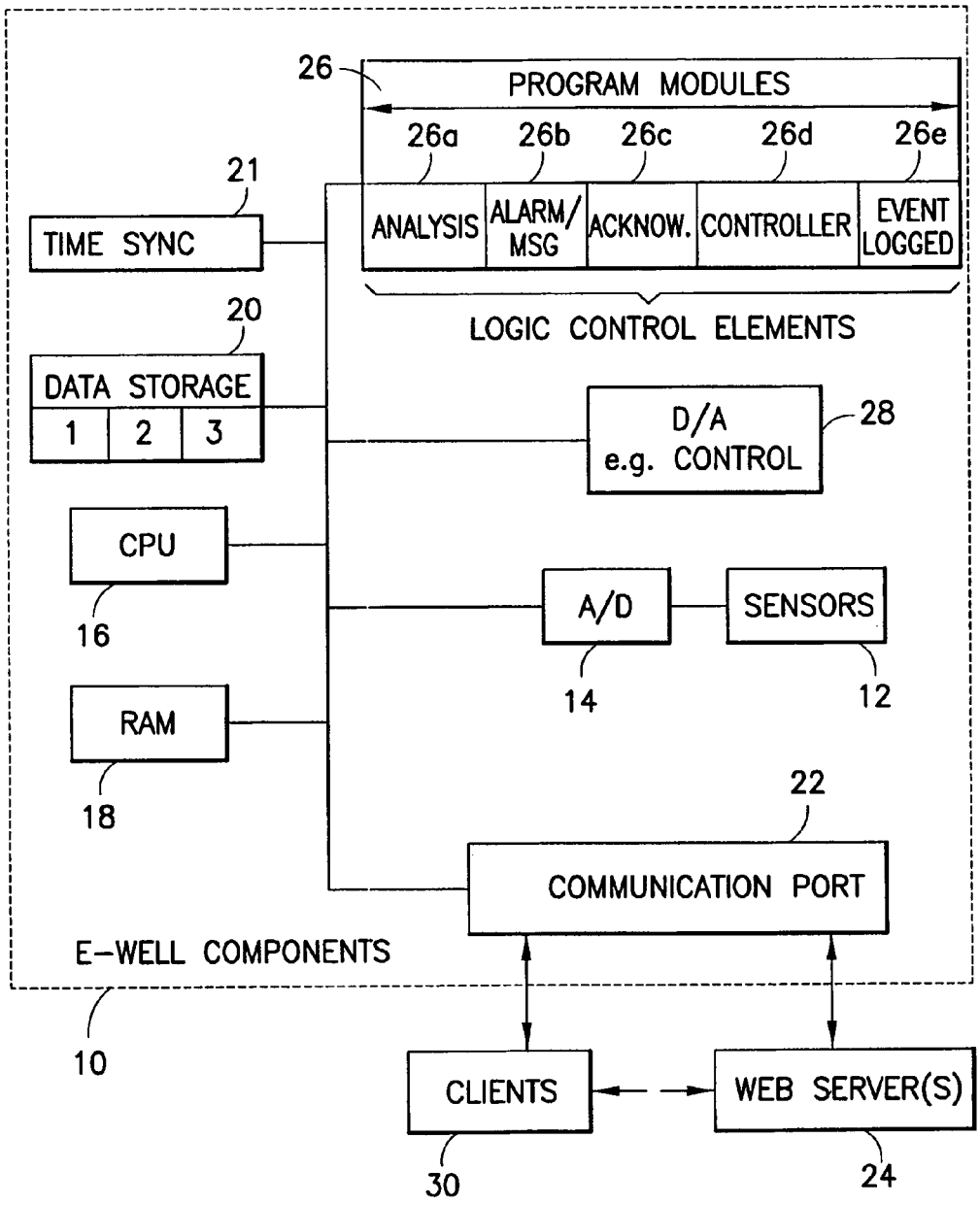
FIG. 1 is a simplified schematic block diagram of components of the invention installed at an oil field.

An apparatus for the remote, real time monitoring of an oil field includes the components shown in FIG. 1 which are referred to as "e-well components" 10. The "e-well components" 10 include one or more sensors 12 which are installed in the oil field in a conventional manner. The sensors 12 (where analog) are coupled via an analog-to-digital converter 14 to a CPU 16 which is provided with RAM 18 and disk storage 20. According to a presently preferred embodiment, a time synchronizer 21 is also provided. The time synchronizer preferably includes algorithms to time synchronize all of the data acquisition. According to one aspect of the invention, the e-well components 10 are coupled to a web server 24 which is preferably located at a central location remote to the oil field. According to another aspect of the invention, the e-well components are provided with a plurality of program modules 26. These modules preferably include an analysis module 26*a*, an alarm/messaging module 26*b*, an acknowledgement module 26*c*, a controller module 26*d*, and an event logger module 26*e*. According to still another aspect of the invention, the e-well components 10 also include a digital to analog interface 28 for controlling oil field equipment as described in more detail below with reference to the acknowledge module 26*c* and the control module 26*d*. According to a presently preferred embodiment, the e-well components 10 are also provided with a direct access communications link 30 so that the components may be accessed, under certain circumstances, without going through the web server 24. The communications link 30 is preferably a direct link to the Internet and is accessed via an IP address. The e-well components 10 shown in FIG. 1 may be replicated for each well in an oil field or may service more than one well in the oil field.

From the foregoing, those skilled in the art will appreciate that the CPU 16 acquires data from the sensors 12 and stores the data in the data storage 20 and also runs the program modules 26. According to the presently preferred embodiment, archival data stored in data storage 20 is compressed. Recently acquired data are left uncompressed and are also maintained in RAM 18 for rapid access and analysis.

For purposes of illustration, K wells are serviced by the components 10. Each well has sensors which provide M classes of data points at N locations. Although M and N may be different for each well, for illustration these may be considered as being maximum values. Each measurement collected by the e-well components is designated $P_{ij}^{(k)}(l)$ where k is the well ID, i is the class of measurement (e.g., formation pressure, wellbore pressure, temperature, voltage, etc.), j is the location in the well, and l is the datapoint (point number for the data set). Data are acquired over an interval $\delta_{t_{ij}}^{(k,l)}$. For simplicity, it is assumed that δ is the same for each well. For every well k, each measurement $P^{(k)}$ is an array of dimensions M×N. Assuming that each measurement requires four bytes, each well will require 4 MN bytes of storage for each time point. Taking one sample per minute, MN×172 Kilobytes memory is required for one month of data. According to a presently preferred embodiment of the invention, as data ages, it is decimated by several degrees. For example, data which is more than a year old is compressed to a first level; data which is more than two years old is compressed to a second level, etc. However, the invention contemplates that data compression is only used for well-site storage and that uncompressed data is periodically uploaded to and stored at a remote host.

The presently preferred data compression scheme is based on the techniques disclosed in Ramakrishnan, T. S. and Kuchek, F., *Testing and Interpretation of Injection Wells Using Rate and Pressure Data*, SPE Formation Eval., 9:228–236 (1994), the complete disclosure of which is hereby incorporated by reference herein. According to this technique, points which show significant change while not being within the tolerance range of linear data fitting are chosen to be preserved. Data are stored in terms of straight lines between preserved data points. Thus, for a first level of compression, the preserved data can be expressed as shown in Equation 1 where b is the intercept, m is the slope, and t is a value consistent with Equation 2.

$$P_{ij}^{(k,l)}(l)=b_{ij}^{(k,l)}(l)+m_{ij}^{(k,l)}(l)t \tag{10}$$

$$\forall t_{ij}^{(k,l)}(l-1)\leqq t\leqq t_{ij}^{(k,l)}(l) \tag{2}$$

As shown in Equation 2, t is a number which is less than or equal to $t_{ij}^{(k,l)}(l)$, the preserved nodes after decimation, but greater than or equal to all of the nodes. As data is to be more compressed, more data is discarded. For example, decimation implies discarding one datum out of every 10. For greater compression, more data is discarded.

As mentioned above, according to the presently preferred embodiment, the CPU 16 uses analysis program modules 26*a* to analyze the data acquired via the sensors 12 and provide the results of the analyses to the web server 24. Furthermore, the analysis results are used by the alarm/message program modules 26*b* to provide immediate notification in the event that an unusual event is detected. The presently preferred analysis modules include bound check, trend check, function check, correlation check, covariance check, and data acquisition frequency check.

Under the bound check analysis, bounds are specified for various variables such as pressure, temperature, watercut, flowrates, etc. If a variable falls outside of bounds, an alarm/message is triggered as described in more detail below with reference to the alarm/message module 26*b*. Examples of alarm/message triggering events include: pressure dropping below the bubble point in a production well, watercut increasing suddenly, temperature changing dramatically, etc.

Under the trend check analysis, data is compared to a specified band from point to point, e.g. historical trends based on the archived data discussed above. Those skilled in the art will appreciate that the data compression process described above is itself a trend checker. If the trend is outside the norm, an alarm/message is triggered as described in more detail below with reference to the alarm/message module 26*b*. An example of an alarm/message triggering trend event is a rapid decline in flow rate, even if the flow rate is within bounds.

Under the function check analysis, one or more functions of the data is compared to a band or bounds. An example of a simple function check analysis is where different sets of data are compared to determine whether their sum or difference exceeds a bound. More specific examples are: when the flow rates of individual wells are within bounds but where the combined flow rates exceeds surface capacity; when pressure in one layer differs from pressure in another layer by more than a certain amount; where water cut from one production stream is very different from the water cut from another stream which is being mixed with it, etc.

Under the correlation check analysis, data sets from one well are compared to data sets from another well over time to determine characteristic signal propagation between two or more wells. An example of a correlation check is comparing, over time, periodic pulsing in one well with changes in pressure in another nearby well. A specific presently preferred embodiment of a correlation check is described in more detail below with reference to FIGS. 2–11.

Under data acquisition frequency check analysis, the frequency of data acquisition from different sensors is compared to set values. Anomalies may be indicative of a data acquisition unit failure or missing data periods, etc. In such a case, an alarm/message may be triggered as described in more detail below with reference to the alarm/message module 26*b*.

Additional computations for the covariance of measurements and their time evolution are contemplated by the invention. Although FIG. 1 shows analyses performed at the e-well components site with the results being forwarded to the web server, complex computations which would tax the CPU 16 are preferably performed by the web server CPU. In such a case, the e-well components will transmit the appropriate data sets to the web server and the web server will perform the analysis and issue alarms/messages in response thereto.

The alarm/message program module 26*b* receives signals from the analysis modules 26*a* when anomalies are detected. According to the presently preferred embodiment, the signals from the analysis modules include an indication of the type of anomaly and its severity. Depending on the severity of the anomaly, the alarm/message module will immediately notify one or more human experts by electronic mail, calling a pager, calling a telephone number, activating an alarm, broadcasting an RF signal, transmitting a signal to a satellite, transmitting a microwave signal, sending a signal via a LAN, or sending a signal via a WAN, etc. The alarm/message module is preferably programmable as to what action should be taken in response to particular anomalies, etc. Some messages may require an acknowledgment if programmed to do so.

The acknowledge module 26*c* keeps track of alarm/messages which have been sent and which require an acknowledgment. The acknowledge module also receives acknowledgements from human experts who have received an alarm/message that requires an acknowledgement. If no acknowledgement is received within a programmed period of time, the acknowledge module may send a signal to the alarm/message module whereafter higher priority messages are generated or may send a signal to the controller module 26*d*. Depending on the level of the warning message, the type of anomaly, and the programming of the acknowledge module, a signal will be sent to the controller module 26*d* if no acknowledgement is received within a programmed period of time. The controller module 26*d* is programmed to take automatic action in response to signals from the acknowledge module which indicate the anomaly and its severity. The controller module communicates with analog devices at the well site(s) via the digital to analog interface 28.

An example of the operations described above can be appreciated where the analysis module determines that the water-cut in a layer has exceeded a programmed value during a programmed interval. If no acknowledgement is received for two alarm/messages, the control module will perform a choke action to throttle the flow from the offending layer. Action following inaction is executed via the auto-action control-module.

According to the presently preferred embodiment, different levels of alarm/messages may be sent requiring different human action at different times and, in the absence of required human action, automatic action taken at programmed times. Also according to the presently preferred embodiment, when multiple humans are notified of an alarm/message, all will be notified of the resulting action, i.e. human intervention by person X, and/or automatic control. It is also preferred that human experts be given priority levels whereby a higher level expert can override the actions of a lower level expert.

The alarm/message module may also be programmed to send messages to other components in the system. For example, in the event of a system restart where data acquisition is interrupted, the alarm/message module may send a message to the CPU to increase the rate of data collection in order to have a more accurate correlation analysis of responses to the perturbation.

As described above, the controller module 26*d* initiates automatic activity according to the program. The automatic activities include, for example, throttling a section down upon sensing an unacceptable water cut, preventing pressure from dropping below a set value by throttling, increasing injection rate for pressure support etc. The controller module may also perform any of these kinds of actions in response to an email from a remotely located expert.

The event logger module 26*e* keeps track of all planned and unplanned events that occur in the field. Examples of planned events include a build-up pressure test, well workovers, change in production rate, etc. An example of an unplanned event is a pump failure that causes a well to shut down. The log of events is provided to the analysis module 26*a*.

As mentioned above, one of the most robust analysis tools is the correlation check. The following is an example of how the correlation check is used in the context of pressure diffusion. According to this example, three vertical line wells are located in a laterally infinite formation. The second well is located 40 meters from the first well. The third well is located 40 meters from the first well and 80 meters from the second well. Each of the wells is capable of producing or injecting fluids. When fluid is injected into one of the wells, pressure response in the other wells is monitored. The rate schedule for fluid injection consists of arbitrary step changes to rates at time points. The step changes are allowed to grow to the new rate with a specified time-constant, i.e. pulses with exponential increase or decline.

The step response function for pressure in well i due to flow in well j is given as $G_{ij}$. For all practical purposes one may superpose the result to give the pressure $p_i$ in well i as shown in Equation 3 where t is time, $\tau$ is a dummy variable of integration, and $q_j$ is the flow in well j. It is assumed that q=0 when t=0.

$$p_i = \sum_j \int_0^t G_{ij}(t-\tau)\, dq_j(\tau) \tag{3}$$

The response function $G_{ij}$ is shown in Equation (4) where $E_1$ is the exponential integral, $\phi$ is the porosity, $\mu$ is the shear viscosity, c is the compressibility, k is the permeability, t is the time, and $r_{ij}$ is the distance from well i to j.

$$G_{ij}(t) = \frac{\mu}{4\pi kh} E_1\left(\frac{\phi\mu c r_{ij}^2}{4kt}\right) \tag{4}$$

For computational purposes, random fluctuations in flow rates are permitted in addition to the imposed steps. The calculations discussed below were carried out with a 2% noise in rates.

In this example wells 1 and 3 are active wells and well 2 is a passive or observation well. The permeability of the formation is 100 md. The viscosity is 1 cp and the compressibility is $4\times10^{-9}$ $m^2$ $N^{-1}$. All the trial calculations included an initial step on which were superimposed random fluctuations. When no additional pulses were included it was found that it was difficult to discern any influence of the random fluctuations. Physically, if the transient time for diffusion is much larger than the time scale of the fluctuations, then the time signature of the random fluctuations is essentially lost at the remote points. Therefore any inference that takes advantage of the propagation of the random fluctuations in unlikely to be robust.

Figure 2:
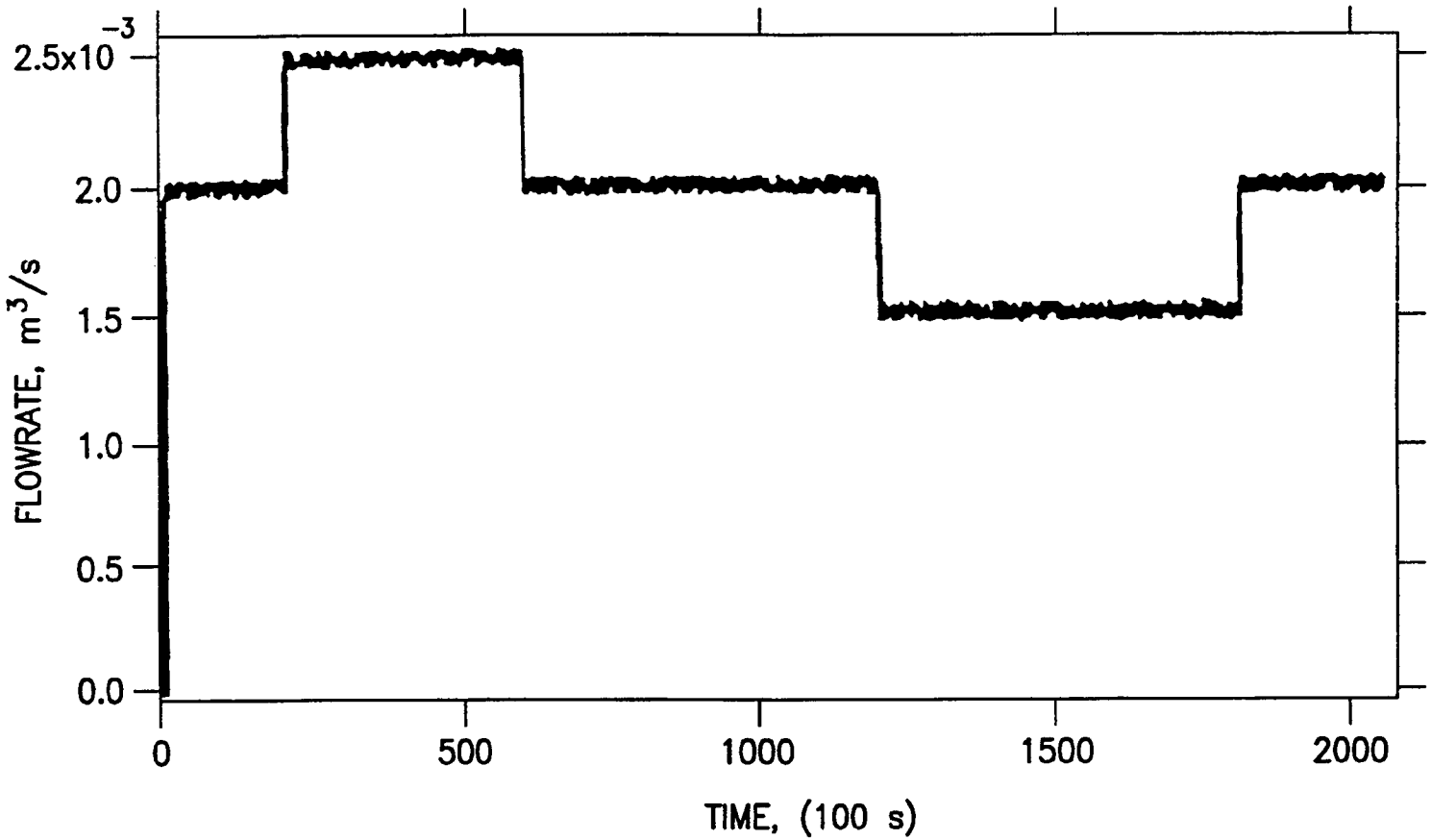
FIG. 2 is an exemplary graph of flowrate of pulsing in a first active well over a period of time.
Figure 3:
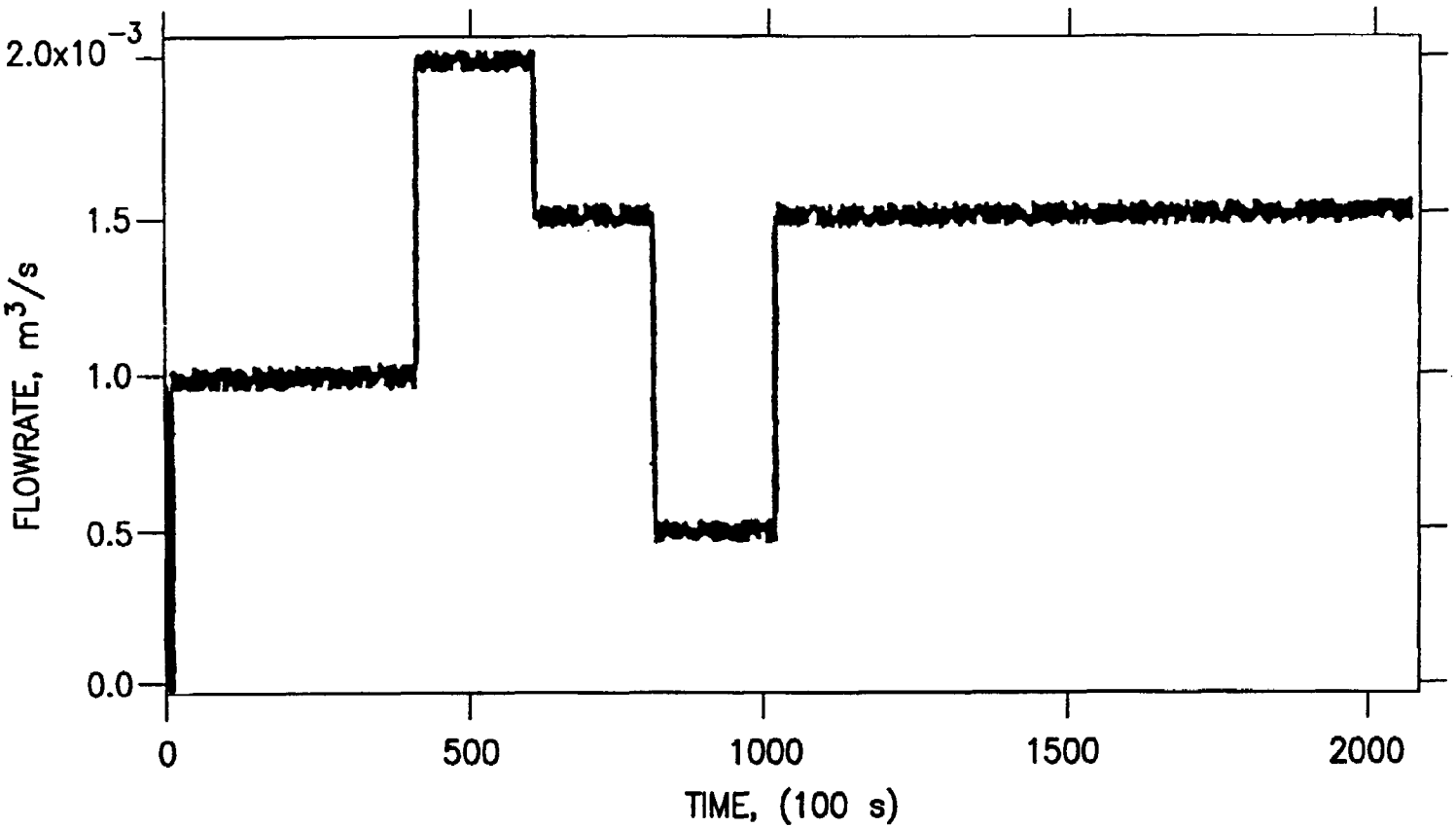
FIG. 3 is an exemplary graph of flowrate of pulsing in a third active well located about 40 meters from the first well over a period of time.

For the above-mentioned reason, experiments were performed with periodic finite-amplitude pulsing of the active wells. The pulsing sequence for wells 1 and 3 is shown in FIGS. 2 and 3, respectively. Based on the proposition that the propagation will be governed by pressure diffusion, whose characteristic time is $r^2/(4D)$, where $D=k/\phi\mu c$ and r is the distance between the source and the observation points, it is concluded that the correlation time for pulse propagation should be expected to approximate this value. Thus, periodic pulsing and a direct correlation function plot will have a peak around the diffusion time-scale.

Correlation may be carried out in a number of different ways. One method is to correlate the flow rate in an active well to the pressure in an observation well. From a signal processing point of view, this is a poor implementation. Because of the finite amplitude background in both the pressure and the flowrate, the correlation function does not indicate diffusion time-scales. After several numerical experimentations a better procedure has been discovered.

The preferred method includes providing or injecting the active wells with a nearly constant rate; and performing a periodic flowrate pulsing of the wells in a manner whereby the active wells are not pulsed at the same time or with the same amplitude. This ensures that the sources are not perfectly correlated and the flowrate pulsing results in pressure fluctuations in each well.

Since the background is predominantly uniform, it is possible to differentiate both the flowrate and pressure data. If necessary, the differentiation may be based on the decimated data, to avoid strong noise influence. This was found this to be unnecessary with 2% noise.

The differentiated data is composed of a nearly null background and pulses. The pressure pulses are, however, diffused according to the distance between the source and the observation points. It is possible to window the differentiated data and evaluate the correlation of two functions through well known FFT methods. The cross-correlation may be done with flowrate and pressure or pressure and pressure (all of them after differentiation with respect to time). The latter has the advantage that it is less noisy, and is easily measured.

According to the preferred method, a search is made for an easily discernible peak in the correlation function. The location of the peak automatically indicates the correlation time. The value of the correlation time is converted to mobility and displayed.

Because of the essentially signal processing nature of the above-described method, the process is automated rather easily. The novelty of the method lies in the conversion of the essential physics of pressure propagation into a signal processing algorithm.

Figure 4:
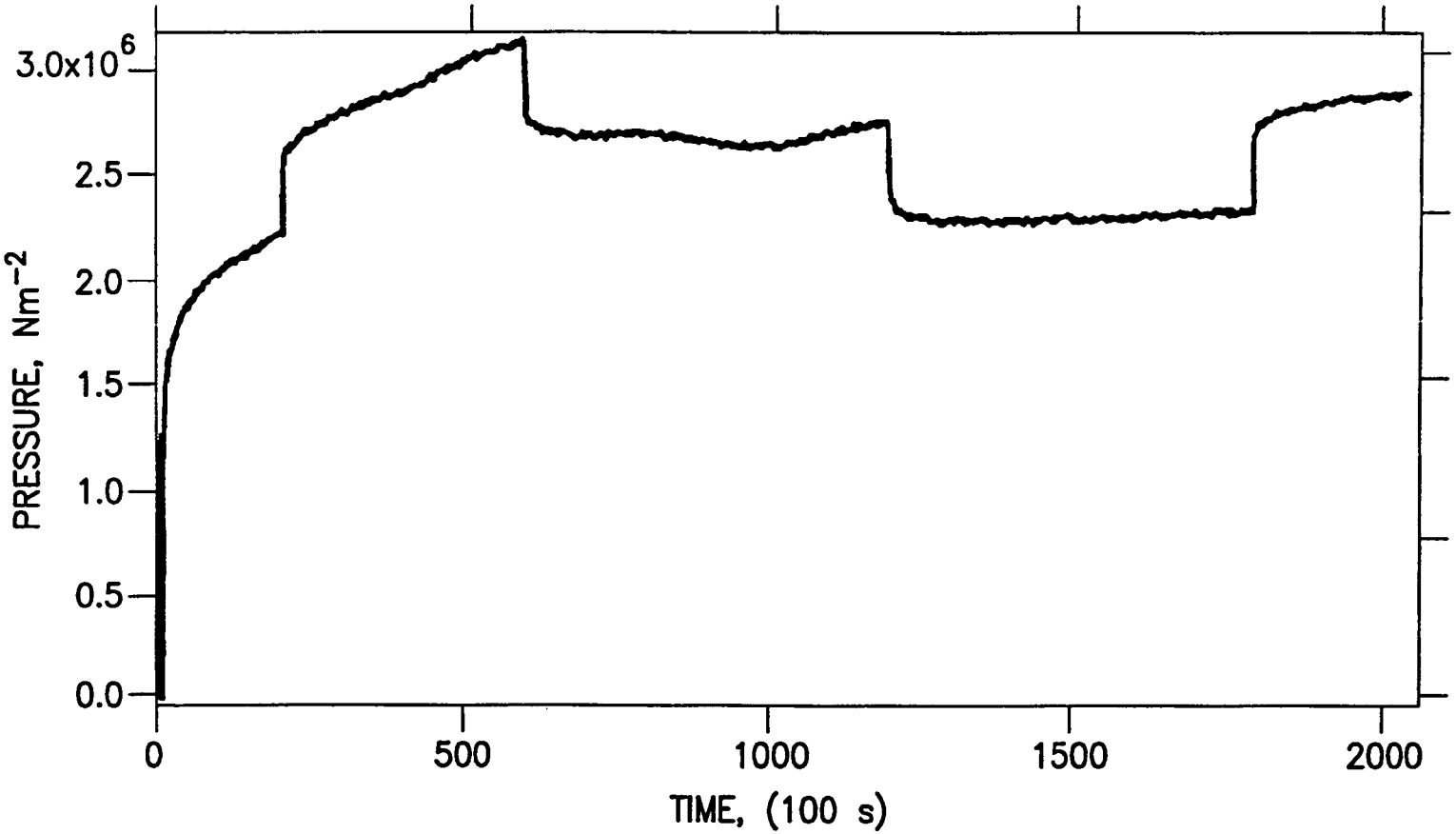
FIG. 4 is an exemplary graph of pressure in the first well over a period of time.
Figure 5:
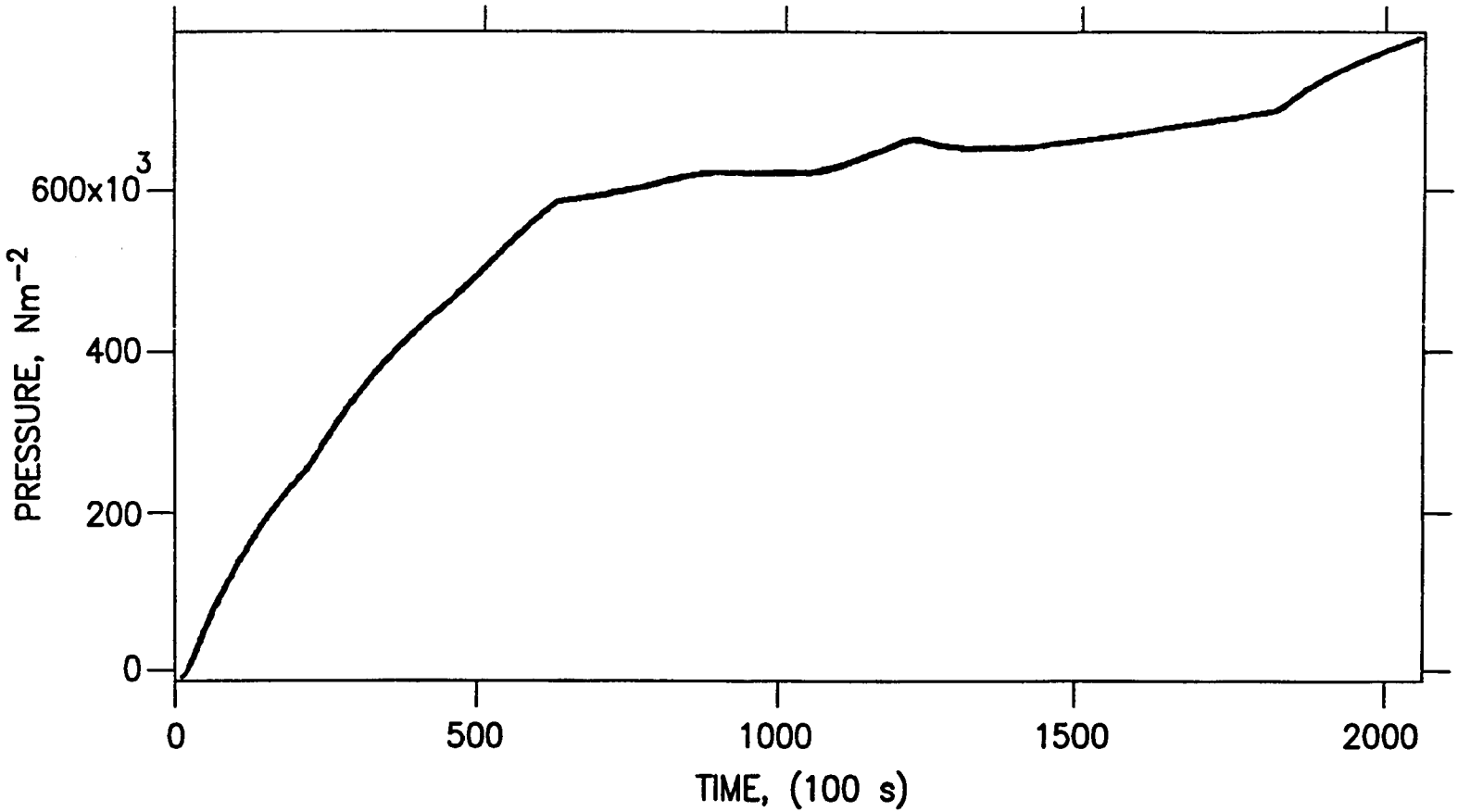
FIG. 5 is an exemplary graph of pressure over a period of time in a second passive observation well which is located about 40 meters from the first well and about 80 meters from the third well.
Figure 6:
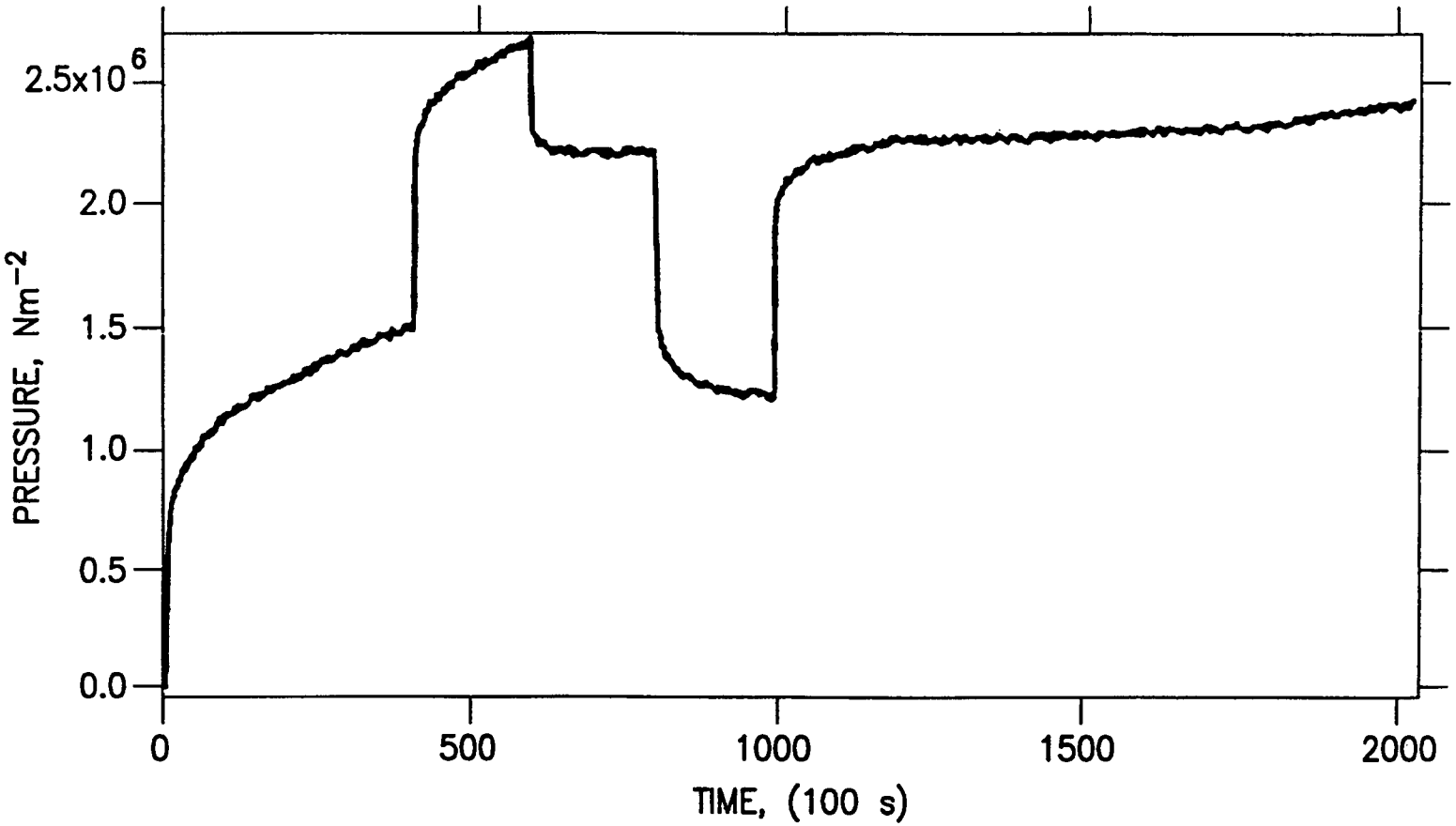
FIG. 6 is an exemplary graph of pressure in the third well over a period of time.
Figure 7:
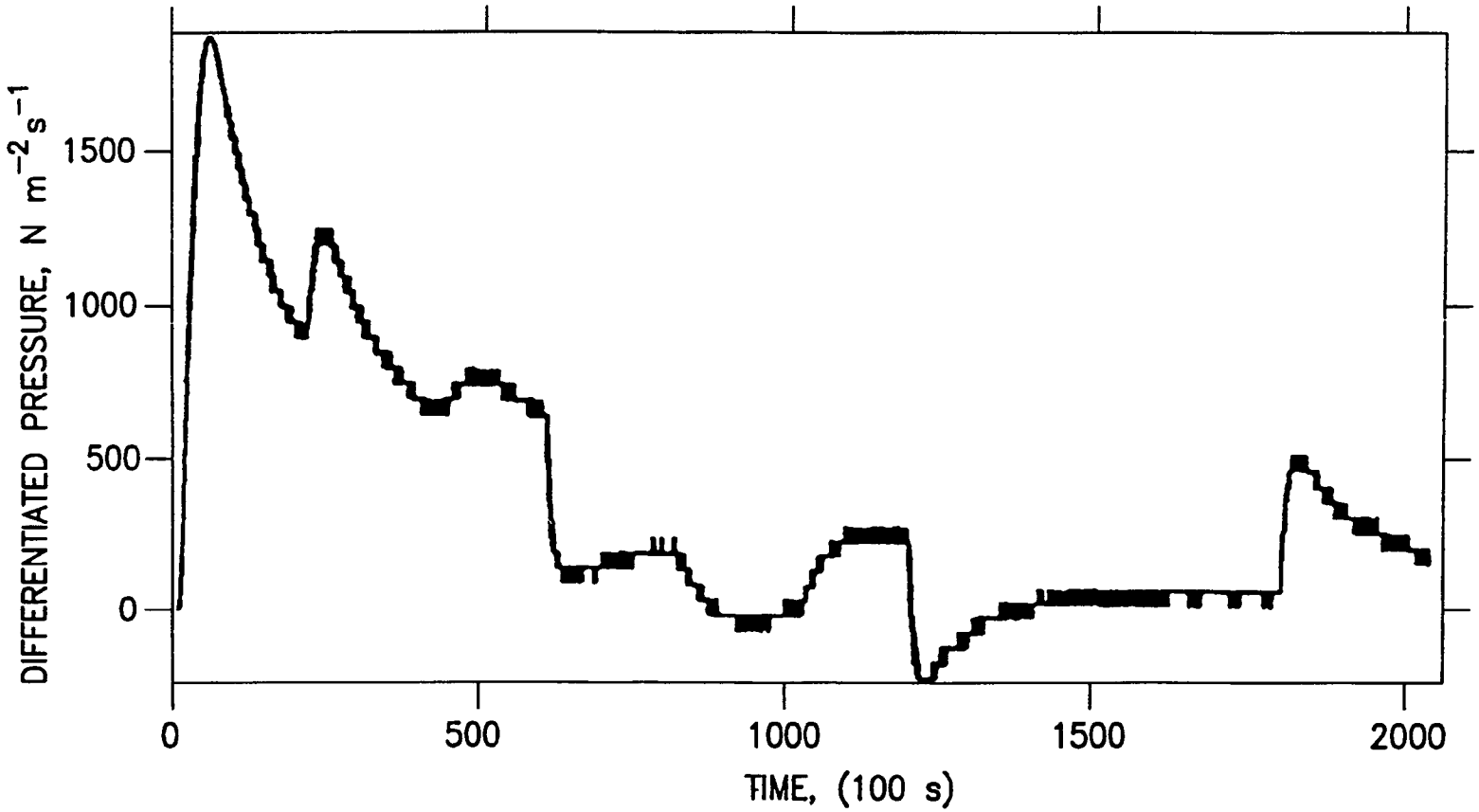
FIG. 7 is an exemplary graph of differentiated pressure in the second well over a period of time.

The above-described method is illustrated with reference to the remaining Figures. For the flowrate pulsing shown in FIGS. 2 and 3, the pressure responses are shown in FIGS. 4–6. As shown, the response in the observation well 2 is sluggish. The differentiated pressure signal in well 2 is shown in FIG. 7 and is clearly noisy. Nevertheless, the intentional pulsing dominates over the noise spikes.

Figure 8:
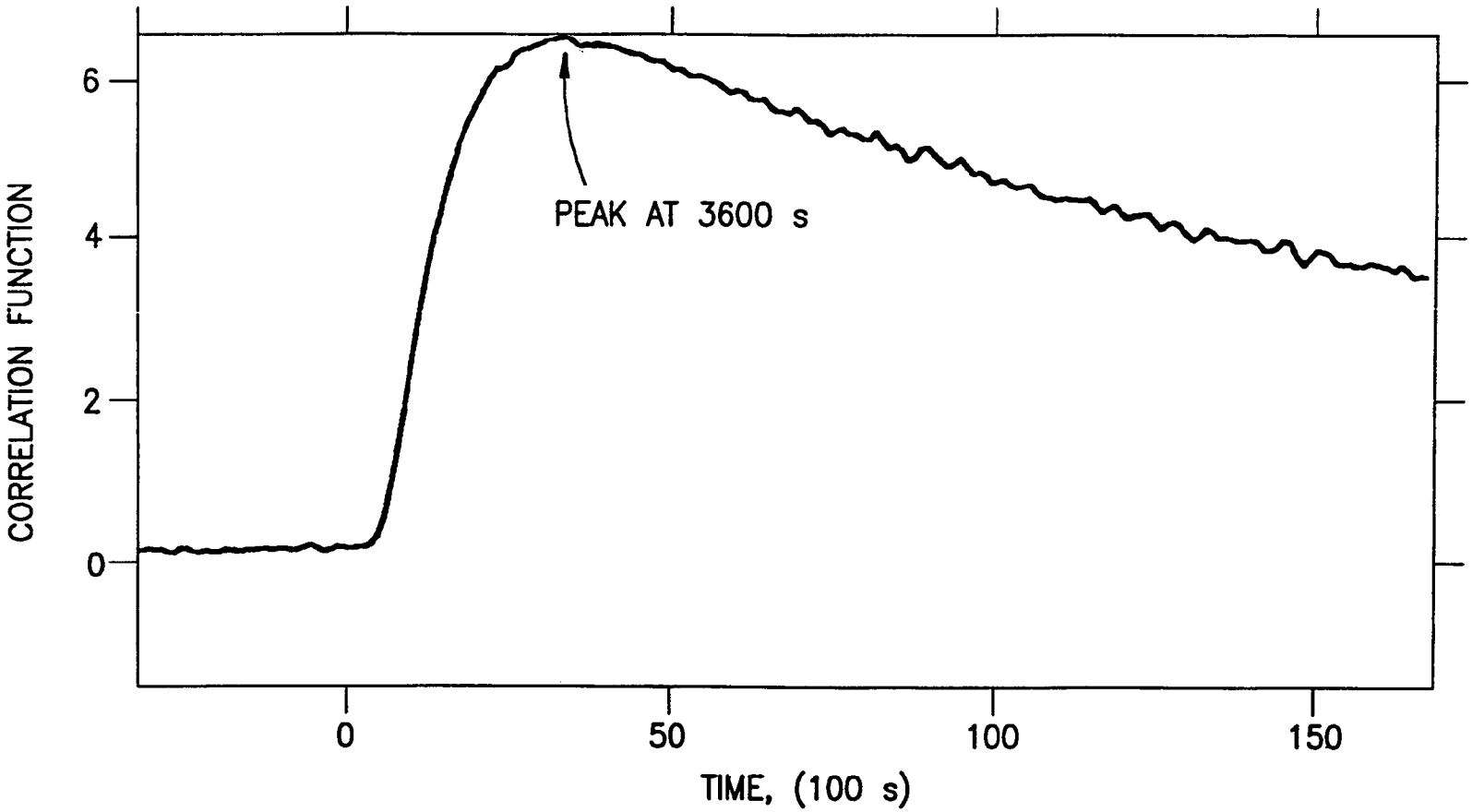
FIG. 8 is an exemplary graph of the correlation function of differentiated flow in the first well with the differentiated pressure in the second well.
Figure 9:
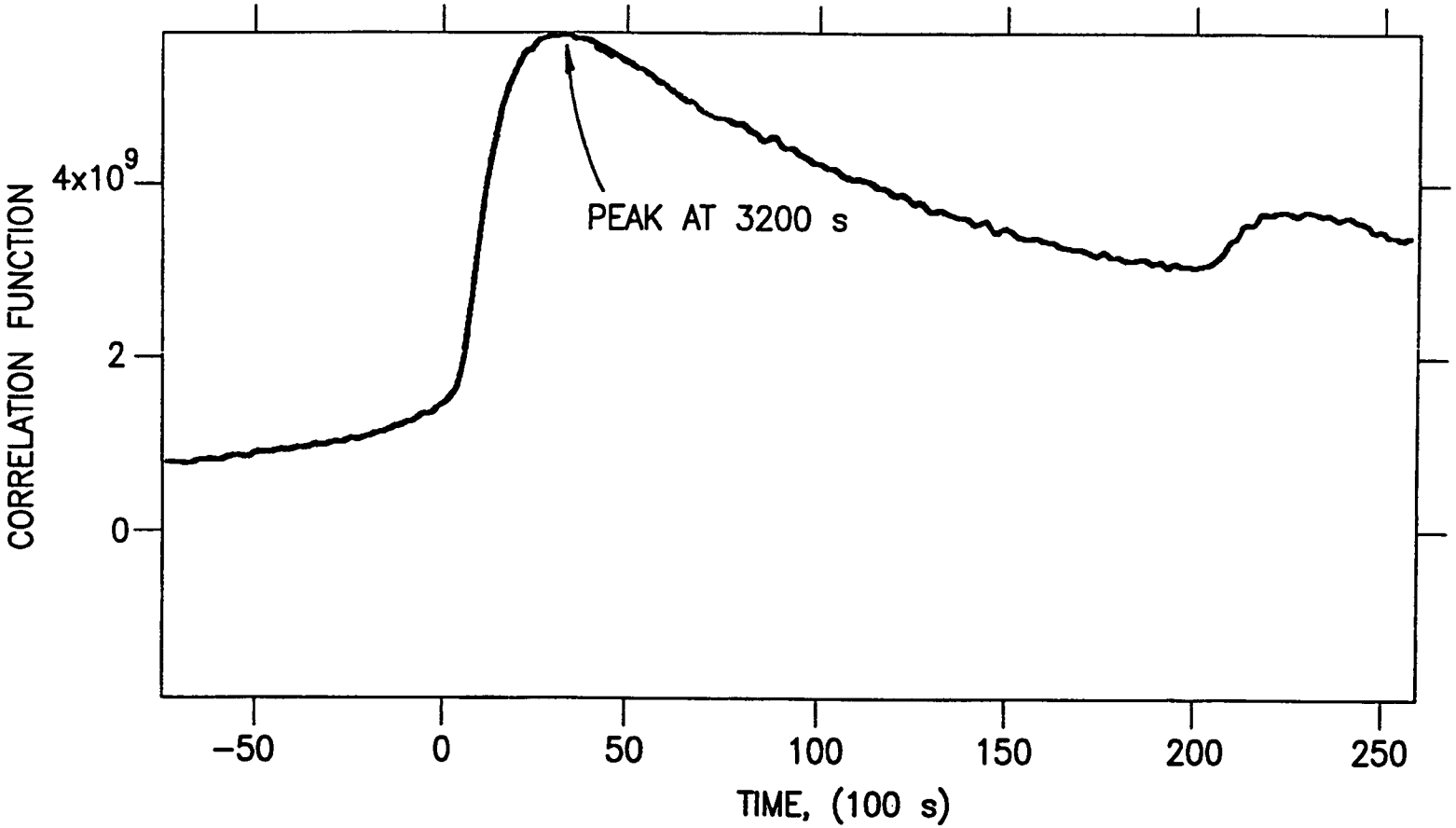
FIG. 9 is an exemplary graph of the correlation function of differentiated pressure in the first well with the differentiated pressure in the second well.

The correlation function between dq/dt in well 1 and dp/dt in well 2 is shown in FIG. 8 and the correlation function between dp/dt in well 1 and dp/dt in well 2 is shown in FIG. 9. The location of the peak in this FIG. 8 is at 3600 s, a measure of the correlation time $T_c$. The peak in FIG. 9 is located at 3200 s.

An estimate of the formation permeability located between wells 1 and 2 may be obtained from Equation 5 which yields 89 mD and 100 mD based on the respective $T_c$ values of 3200 and 3600 where $\mu$=0.001 kg/m/s, $c=4\times10^{-9}$ $m^2N^{-1}$, and $r_{ij}$ is the distance between the wells.

$$k = \frac{\phi\mu c r_{ij}^2}{4T_c} \tag{5}$$

Figure 10:
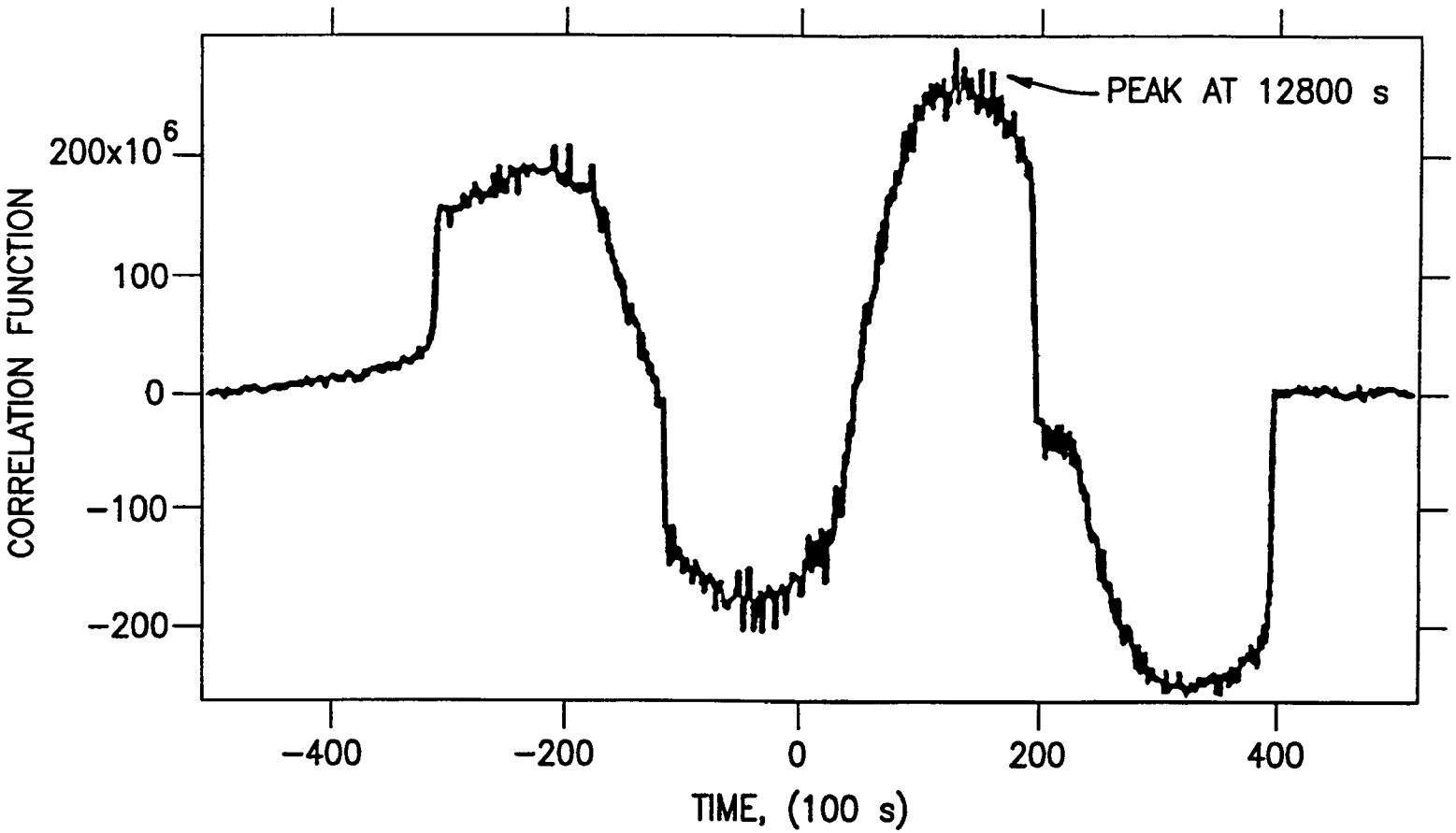
FIG. 10 is an exemplary graph of the correlation function of windowed differentials pressure between the second well and the third well.

A similar analysis was performed between well 2 and 3 and the peak in the correlation function was no longer reflective of the formation property. The distance between these two wells is 80 meters and the interaction signal is dwarfed compared to the one between wells 1 and 2. For example, consider a pulse in well 1 with no change in well 3. Because wells 2 and 3 are both 40 meters away from well 1, and there is no other fluctuation other than that imposed in well 1, wells 2 and 3 experience a response corresponding to a distance of 40 meters. These two signal changes are essentially the same in both the wells and will therefore have zero time displacement. Rather than have a correlation function peak at 12800 s=80 m, a peak will appear at zero. Thus, interaction between distant wells will be badly affected by more dominant near-well signals. This may be circumvented by looking at a targeted window correlation function calculation. Taking a window around 1000 s where well 1 has no pulse, a correlation function based on this window is shown in FIG. 10. The correlation function peak now is in agreement with the diffusion time scale of 12800 s. Thus, any automated pulsing sequence and windowing should be implemented so that the observation-active well interaction is the dominant one.

Figure 11:
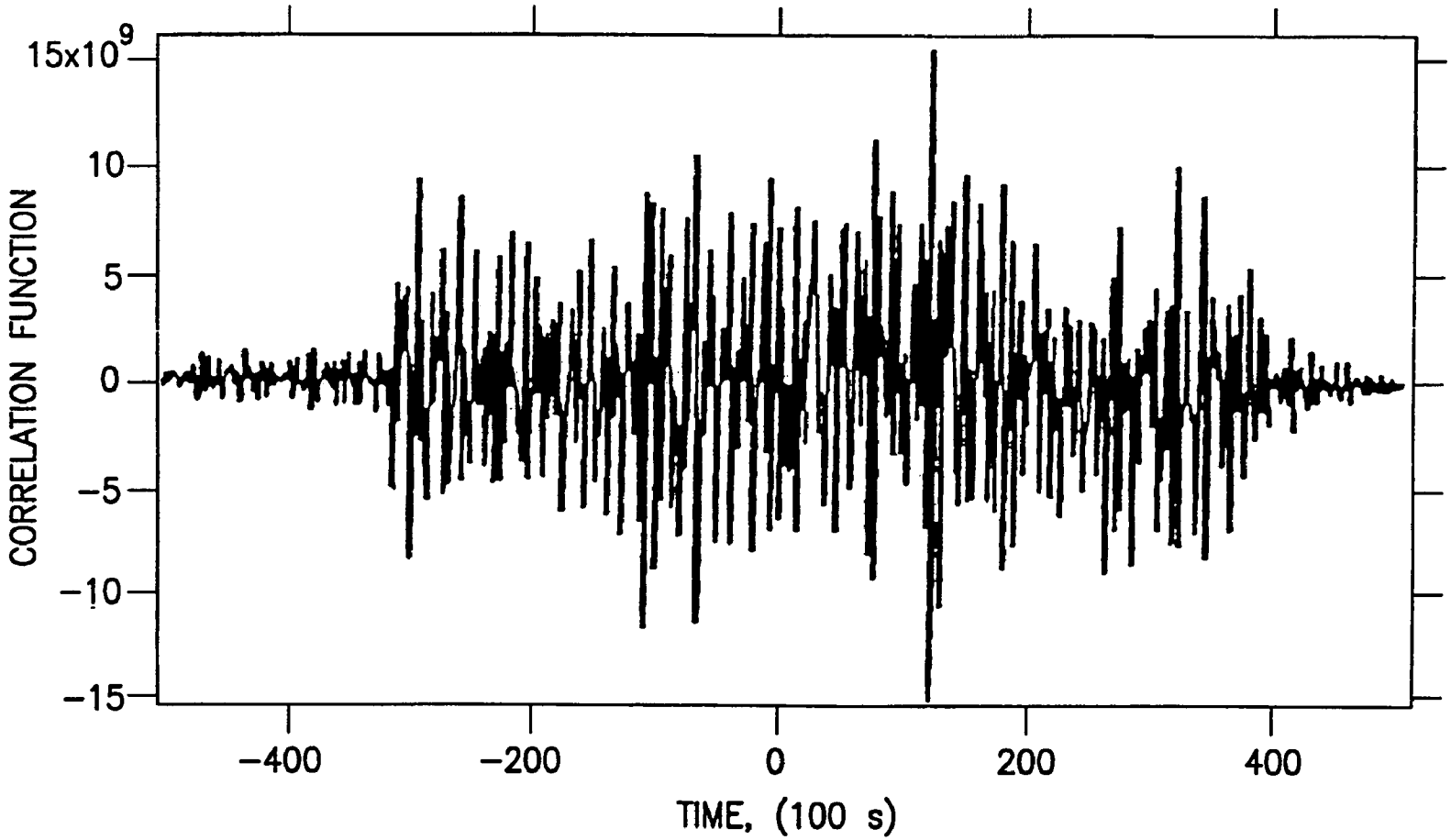
FIG. 11 is an exemplary graph of the correlation function of windowed differentials pressure between the first well and the third well.

Although the Example given above demonstrates the correlation method between an active well and an observation point, the same type of correlation can be performed between two active wells. As described above, it must be ensured that only one well is pulsed at a time. For the same window around 1000 s, the correlation function between wells 1 and 3 is shown in FIG. 11. The correlation function is noisy, with no discernible peak, meaning that the local noise (if present) in a production well will dominate over response due to distant action. If the response had been ideal, a distance of 40 m suggests a peak for the correlation function would appear at 3200 s just as in FIG. 9.

The following conclusions may be drawn based upon the above numerical calculations. First, orrelation functions between differentiated pressure/flowrate at the source and the pressure at the nearest (in the sense of pressure diffusion) observer are relatively robust, and a fairly sharp peak is indicative of the properties of the intervening formation. Second, the correlation gets broader as the distance to the observation well increases. Thus, the uncertainty increases. Third, in the presence of noise, evaluation of interaction between observation wells is not feasible with selective pulsing and windowing. Fourth, straightforward signal processing methods that take into account diffusion physics can be used in either a manual or automatic mode to generate reservoir properties between two wells or zones of interest. Such a table of generated values may be relayed periodically from the well site(s) to the web server shown in FIG. 1.

There have been described and illustrated herein several embodiments of methods and apparatus for remote real time oil field management While particular embodiments of the invention have been described, it is not intended that the invention be limited thereto, as it is intended that the invention be as broad in scope as the art will allow and that the specification be read likewise. It will therefore be appreciated by those skilled in the art that yet other modifications could be made to the provided invention without deviating from its spirit and scope as so claimed.

We claim:

1. A method for remote real time oil field management, comprising:

a) installing at least one sensor in an oil field;

b) coupling the at least one sensor to a CPU memory located at the oil field;

c) programming the CPU to collect and store data from the at least one sensor;

d) programming the CPU to at least partially analyze the data; and e) providing remote access to the data, wherein:

said step of programming the CPU to at least partially analyze the data includes programming the CPU to determine covariance of the data.

2. A method according to claim 1, further comprising:

f) providing remote access to the at least partial analysis via the Worldwide Web.

3. A method according to claim 2, wherein:

said step of programming the CPU to at least partially analyze the data includes programming the CPU to determine whether data falls outside programmed bounds.

4. A method according to claim 2, wherein:

said step of programming the CPU to at least partially analyze the data includes programming the CPU to determine whether the data is following a trend.

5. A method according to claim 2, wherein:

said step of programming the CPU to at least partially analyze the data includes programming the CPU to determine whether a function of the data falls outside programmed limits.

6. A method according to claim 2, wherein:

said step of programming the CPU to at least partially analyze the data includes programming the CPU to apply a correlation function.

7. A method according to claim 1, further comprising:

coupling the CPU to a separate Web server.

8. A method according to claim 1, wherein:

said step of programming the CPU to store data includes programming the CPU to compress data.

9. A method for remote real time oil field management, comprising:

a) installing at least one sensor in an oil field;

b) coupling the at least one sensor to a CPU with memory located at the oil field;

c) programming the CPU to collect and store data from the at least one sensor;

d) programming the CPU to at least partially analyze the data;

e) providing remote access to the data; and f) programming the CPU to determine whether results of the at least partial analysis correspond to an anomaly, wherein said anomaly is a parameter going out of bounds within a predetermined interval.

10. A method according to claim 9, further comprising:

g) programming the CPU to automatically notify one or more persons if the results of the at least partial analysis corresponds to an anomaly, wherein said step automatically notifying includes one of sending electronic mail, calling a pager, calling a telephone number, activating an alarm, broadcasting an RF signal, transmitting a signal to a satellite, transmitting a microwave signal, sending a signal via a LAN, or sending a signal via a WAN.

11. A method for remote real time oil field management, comprising:

a) installing at least one sensor in an oil field;

b) coupling the at least one sensor to a CPU with memory located at the oil field;

c) programming the CPU to collect and store data from the at least one sensor; and d) providing remote access to the data, wherein said step of programming the CPU to store data includes programming the CPU to decimate based on age of the data.

12. A method according to claim 11, wherein:

older data is decimated at a higher proportion than newer data.

13. An apparatus for remote real time oil field management, comprising:

a) at lease one sensor installed in an oil field;

b) at least one CPU with memory located at the oil field coupled to said at least one sensor, said at least one CPU being programmed to collect data from said at least one sensor and store the date in said memory; and c) communications means for coupling said CPU to a communications network, wherein said CPU is programmed to determine covariance of the data.

14. An apparatus according to claim 13, wherein:

said CPU is programmed to at least partially analyze the data; and said communications network includes the Worldwide Web.

15. An apparatus according to claim 13, wherein:

said CPU is programmed to determine whether data falls outside programmed bounds.

16. An apparatus according to claim 13, wherein:

said CPU is programmed to determine whether the data is following a trend.

17. An apparatus according to claim 13, wherein:

said CPU is programmed to determine whether a function of the data falls outside programmed limits.

18. An apparatus according to claim 13, wherein:

said CPU is programmed to apply a correlation function to the data.

19. An apparatus according to claim 13, further comprising:

d) a separate Web server coupled to said CPU.

20. An apparatus according to claim 13, further comprising:

d) data compression means for compressing data stored by said CPU.

21. An apparatus for remote real time oil field management, comprising:

a) at least one sensor installed in an oil field;

b) at least one CPU with memory located at the oil field coupled to said at least one sensor, said at least one CPU being programmed to collect data from said at least one sensor and store the data in said memory; and c) communications means for coupling said CPU to a communications network, wherein said CPU is programmed to at least partially analyze the data, said CPU is programmed to determine whether results of the at least partial analysis correspond to an anomaly and said anomaly is a parameter going out of bounds within a predetermined interval.

22. An apparatus according to claim 21, further comprising:

d) means for automatically notifying one or more persons when the CPU determines that the results of the at least partial analysis correspond to an anomaly.

23. An apparatus according to claim 22, wherein:

said means for automatically notifying is selected from the group consisting of means for sending electronic mail, means for calling a pager, means for calling a telephone number, means for activating an alarm, means for broadcasting an RF signal, means for transmitting a signal to a satellite, means for transmitting a microwave signal, means for sending a signal via a LAN, and means for sending a signal via a WAN.

24. An apparatus for remote real time oil field management, comprising:

a) at least one sensor installed in an oil field;

b) at least one CPU with memory located at the oil field coupled to said at least one sensor, said at least one CPU being programmed to collect data from said at least one sensor and store the data in said memory;

c) communications means for coupling said CPU to a communications network; and d) data compression means for compressing data stored by said CPU, wherein said data compression means includes means for decimating data based on age of the data.

25. A method, comprising:

a) installing at least one sensor in an oil field;

b) coupling the at least one sensor to a CPU with memory located at the oil field;

c) programming the CPU to collect and store data from the at least one sensor;

d) providing remote access to the data;

e) programming the CPU to at least partially analyze the data; and f) programming the CPU to apply a correlation function, wherein said step of programming the CPU to apply a correlation function includes programming the CPU to i. let active wells produce or inject with a nearly constant rate; and ii. perform a periodic flowrate pulsing of the wells in a manner whereby the active wells are not pulsed at the same time or with the same amplitude.

26. A method according to claim 25, further comprising:

said step of programming the CPU to apply a correlation function includes programming the CPU to measure pressure response in passive wells while pulsing in the active wells.

27. A method according to claim 26, further comprising:

said step of programming the CPU to apply a correlation function includes programming the CPU to differentiate the pressure responses.

28. A method according to claim 27, further comprising:

said step of programming the CPU to apply a correlation function includes programming the CPU to differentiate the flow rates.

29. A method according to claim 28, further comprising:

said step of programming the CPU to apply a correlation function includes programming the CPU to cross correlate differentiated data.

30. A method according to claim 29, further comprising:

said step of programming the CPU to apply a correlation function includes programming the CPU to determine a discernible peak in the cross correlated differentiated data.

31. A method according to claim 30, further comprising:

said step of programming the CPU to apply a correlation function includes programming the CPU to convert the data value at the peak to mobility.

* * * * *